United States Patent [19]

Scheffer

[11] Patent Number: 4,457,352

[45] **Date of Patent: * Jul. 3, 1984**

[54] SYSTEM AND PROCESS FOR THE ABATEMENT OF CASTING POLLUTION, RECLAIMING RESIN BONDED SAND, AND/OR RECOVERING A LOW BTU FUEL FROM CASTINGS

[76] Inventor: Karl D. Scheffer, 121 Governor Dr., Scotia, N.Y. 12302

[ * ] Notice: The portion of the term of this patent subsequent to Apr. 20, 1999 has been disclaimed.

[21] Appl. No.: 369,529

[22] Filed: Apr. 19, 1982

Related U.S. Application Data

[63] Continuation-in-part of Ser. No. 130,256, Mar. 14, 1980, Pat. No. 4,325,424.

[51] Int. Cl.[3] ..... B22D 23/00; B22D 27/15

[52] U.S. Cl. ..... 164/5; 164/7.1; 164/61; 164/255; 164/124

[58] Field of Search ..... 164/5, 7.1, 160.1, 124, 164/61, 62, 12, 16, 255, 76.1

[56] References Cited

U.S. PATENT DOCUMENTS 4,222,429 9/1980 Kemp ..... 164/34
4,325,424 4/1982 Scheffer ..... 164/5

*Primary Examiner*—Kuang Y. Lin

[57] ABSTRACT

Air is caused to flow through the resin bonded mold to aid combustion of the resin binder to form a low BTU gas fuel. Casting heat is recovered for use in a waste heat boiler or other heat abstraction equipment. Foundry air pollution is reduced, the burned portion of the molding sand is recovered for immediate reuse and savings in fuel and other energy is achieved.

12 Claims, 5 Drawing Figures

FIG. 3
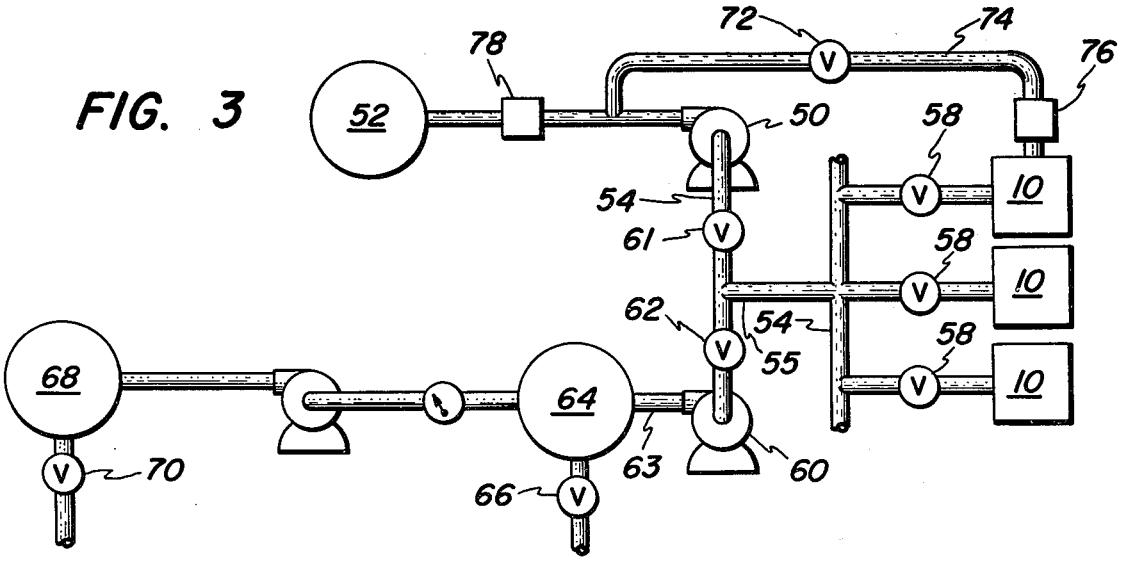
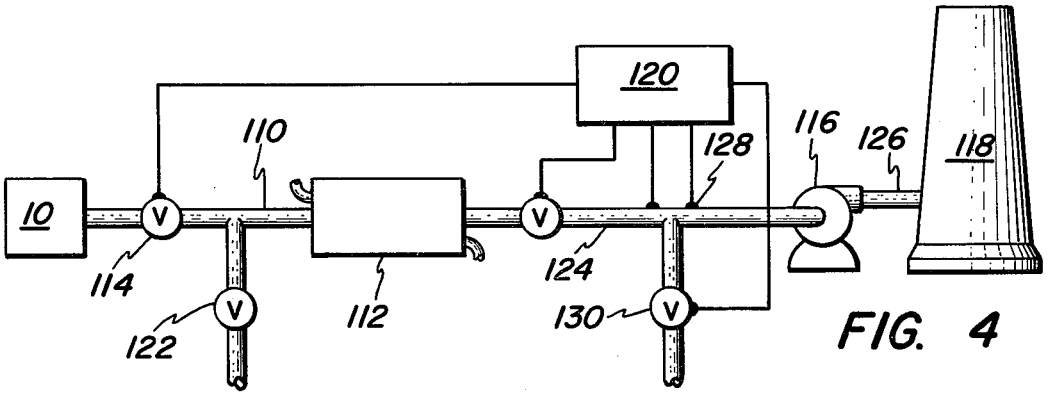
FIG. 4
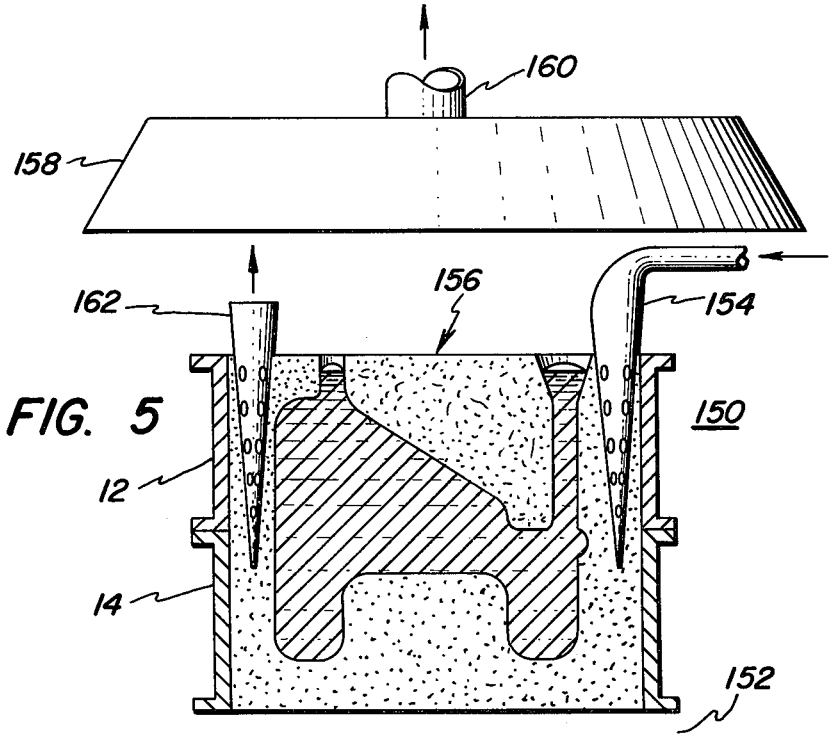
FIG. 5

BRIEF DESCRIPTION OF THE INVENTION

In accordance with the teachings of this invention there is provided a new and improved mold system and process for nobake casting mold assemblies. Each mold comprizes a cope, a drag, and a nobake foundry sand composition. A first means connected to the mold for inducing a flow of air through the sand composition of the mold to aid combustion of the organic binding material to produce a low BTU content gas. A second means is connected to the mold for collecting the low BTU content gas. Combustion air is mixed with the low BTU content gas to form a combustible mixture. Thereafter the combustible mixture is burned to generate thermal energy to preheat combustion air as required, produce hot water, and enable one to heat treat castings in the molds.

DESCRIPTION OF THE DRAWINGS

FIG. 3 is a schematic of an alternate embodyment of the system of FIG. 2.

FIG. 4 is a schematic of another alternate embodyment of the system of FIG. 2.

FIG. 5 is a side elevation view in cross-section of an alternate embodyment of a mold assembly.

DESCRIPTION OF THE INVENTION

Figure 1:
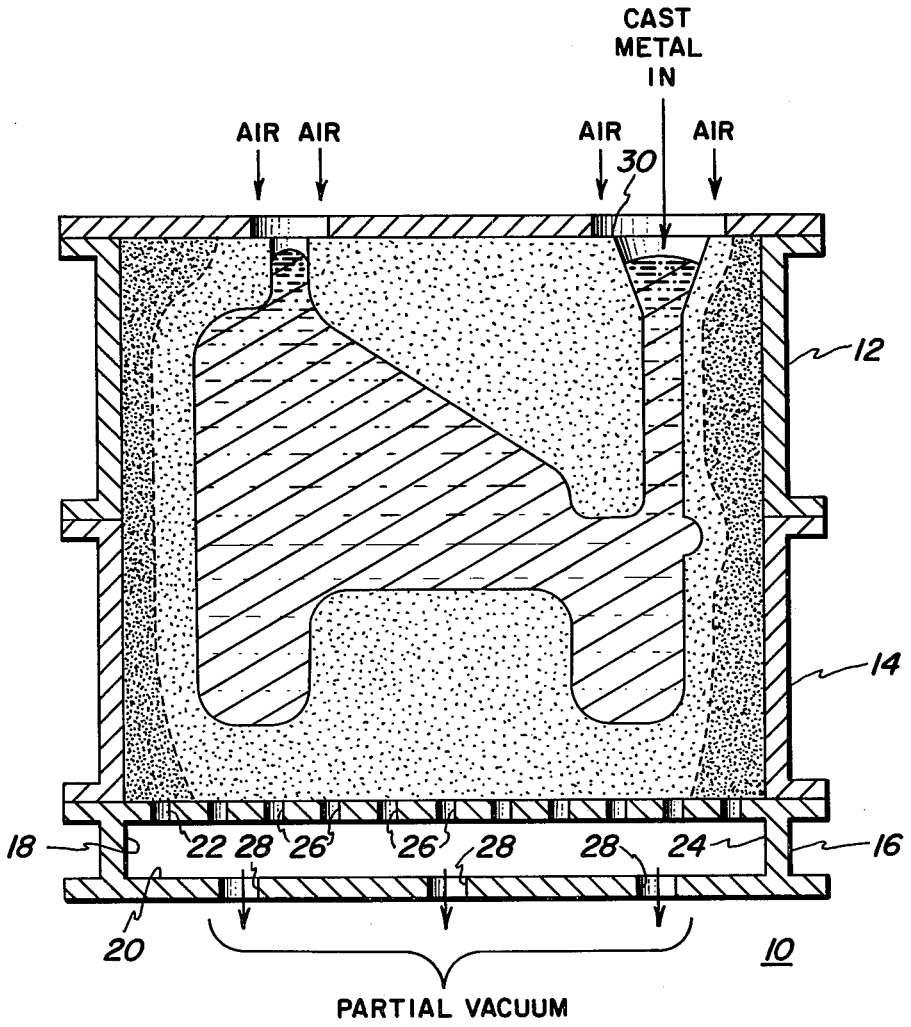
FIG. 1 is a side elevation view in cross section of a mold assembly embodying a vacuum plenum member.
Figure 2:
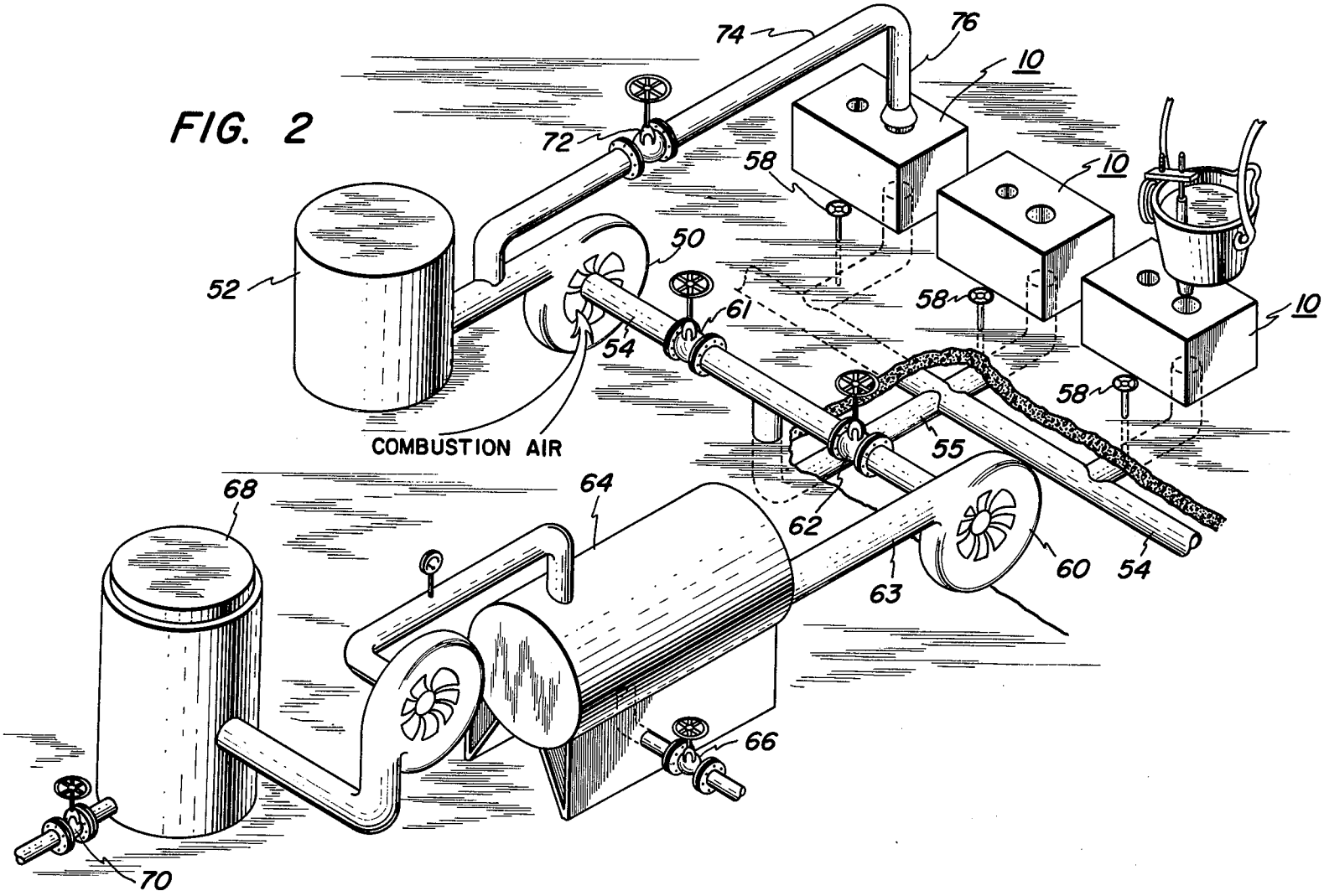
FIG. 2 is a schematic view of a system for recovering and employing a low BTU fuel produced by the molding system of this invention.

With reference to FIGS. 1 and 2, there is shown a mold assembly 10 comprizing a cope 12, a drag 14, and a perforated support member 16 having walls 18, 20, 22 and 24 defining plenum chamber therein. Organic resin bonded sand is shaped on a pattern to form the cavity to be cast therein. The member 16 supports the mold assembly 10 and may be sealed at its juncture with the bottom of the mold assembly 10 to provide a good air-tight-seal therewith. In a similar manner an air tight seal is provided by the abutting surfaces of the cope 12 and drag 14. Walls 26 define a plurality of apertures extending entirely through the wall 20 to provide a comunicant means for air to flow.

Vacuum means, not shown, are attached to the support member and when operative, cause air to draw downward through the mold assembly 10 from the top surface 30, through the apertures defined by walls 26 and 28 respectively. The vacuum is applied shortly before casting the metal. The vacuum is maintained during casting and at least a portion of the time after the casting is completed and before the shakeout occurs. The air which is drawn into the sand of the mold 20 is heated by the cast metal in the regions of the sand about the metal casting thereby forming an initial hot sand zone. The heat is sufficient to make the sand become incandescent. The heated air supports combustion of the organic binder residues and increases the heat content of the air causing the initial hot sand zone to grow greater in size and extend further from the casting towards the end and side surfaces of the mold assembly 10. An everincreasing amount of organic binder material is burned out of the sand mold. The greatest growth of the hot sand zone is that portion of the mold assembly in direct communication with the vacuum means. Approximately 50 to 70 percent by volume of the sand can be burned free of its organic binder materials.

In the nobake mold making system to which this invention is directed, the organic material comprizes from 1 to 2 percent by weight of the sand composition and include furan, alkyd resins, phenol formaldehyde, phenolin, phenolic urethane, and the like materials. The particular choice of binder material depends upon the type of casting practice followed, type of molds being used, and particularly the time alloted to mold preperation to meet the economics of a particular foundry operation practice. Furans and alkyd binders normally set slowly while phenolics and polyurethanes are known to set faster. The choice is determined by foundry practice, preference, and/or economics, or other.

The volume of air and the flow rate of air can both be controlled in this system to produce a low BTU gas content in the hot gases. The hot gases which include the low BTU gas therein, are recovered to be burned in a waste heat boiler and/or other heat recovery unit to extract the heat values from the low BTU gas as well as the casting heat content of the gas. The low BTU gas and hot gas mixture may also be employed as a means for providing heat in hot top casting practices.

The burn-out efficiency of the process, as well as the BTU content of the low grade gas is dependent upon the type of molding equipment employed, the configuration of the casting poured, the molding sand to cast metal ratio, the amount of sand mold surface exposed directly to the surrounding ambient in the foundry, and the design of the system to cause the air to be drawn through the mold and to transport the gases from the mold to a particular distant point. Should the ambient air of the foundry be drawn in over the whole mold surface, the low BTU gas is diluted by the excess air drawn through the mold. Should the mold surfaces be sealed completely against the entrance of air by such suitable means as a spray coating material, sheets of material, and the like, the only air able to enter into the mold will be drawn into the mold around incandescent portions of the mold surrounding the pouring cup and open rizers which project to the top mold surface. The combustion air and organic binder material produces a low BTU gas. The combustion, or burning of the organic resin binder material occurs in a straight line from the initial point of combustion to the perimeter of the casting and then fairly directly toward the plenum chamber of the support member 16. Some expansion of the initial burned out regions occur as a result of binder residue combustion, heat conduction and gas diffusion into the abutting nobake sand composition.

Upon completion of casting the molten metal and further combustion of the organic materials cannot be achieved, the vacuum may be increased to draw greater quantities of air through the mold in order to cool the casting faster. For best all around results, cooling of the casting should be achieved through a separate air evacuation system.

Castings made in this manner have been evaluated and found to have better qualities because of less surface gas in contact with the casting and surface roughness has also been reduced from prior art casting methods.

As illustrated in FIG. 2, the vacuum means may be supplied by a blower 50 which mixes the low BTU gases with a sufficient quantity of air to fire a waste heat boiler 52. Means for transporting the low BTU gas from each mold 10 to blower 50 may be conduit means 54 and 55, a valve means 61, and a conduit means 54 in the floor 56 controlled by flow valve 58. In this instance the combustion of the low BTU gas from the mold 10 is

SYSTEM AND PROCESS FOR THE ABATEMENT OF CASTING POLLUTION, RECLAIMING RESIN BONDED SAND, AND/OR RECOVERING A LOW BTU FUEL FROM CASTINGS

A part of the work described in this application was supported by funds obtained under contract DE-FG01-81CS-15036 from the U.S. Department of Energy.

CROSS REFERENCE TO RELATED PATENT APPLICATION

This application is a continuation-in-part of my copending patent application Ser. No. 130,256 filed on Mar. 14, 1980 and now U.S. Pat. No. 4,325,424 issued Apr. 23, 1982.

BACKGROUND OF THE INVENTION

1. Field of Invention

This invention relates to resin bonded sand molds and in particular to a system and process for reducing casting pollution, recovering a portion of the molding sand for reuse, producing a low BTU fuel gas by partial combustion of the bonding resin, and recovering a portion of the casting heat.

2. Description of the Prior Art

Heretofore, current foundry practice employing nobake molds and cores have ventilation and sand reclamation operations. Organic waste products are removed from molds and cores in dry scrubbers and transported to dumping sites for disposal. The scrubbed sand is returned for reuse. At the present time there is no practical use for recovered binder residues. Care must be exercised in disposing of organic waste products, since they pose a potential problem for the environment.

Present ventilation systems include the dilution of foundry air with large quantities of unpolluted air and removing the same from the foundry by forced air and/or induced air systems. The air removed from the foundry is exhausted into the outside atmosphere where air standards are still lenient enough to permit such operation. The existing systems must move huge quantities of air and are therefore expensive to install and maintain operation thereof. Additionally, extra fuel is required to preheat the make-up air for the foundry operation.

Under normal foundry practice, large quantities of dust can be present in the foundry environment. This is particularly true in the areas devoted to pouring and shakeout operations. As stated in a volume of the American Society for Metals Handbook, silica dust can produce silicosis if there is sufficient exposure, in terms of time and concentration, to free crystalline silica dust of a particle size below five microns. When silica dust concentrations greatly exceed the maximal allowable, a case of silicosis can develop in two to twenty years, the average being ten years.

In nobake molding practices employing organic sand binders environmental affects must be considered for products of the thermal decomposition of the organic binders. The smoke and thermal decomposition products require control equipment. Thermal decomposition products include, but are not limited to, carbon monoxide, carbon dioxide, nitrogen, hydrogen, methane, formaldehyde, ammonia, hydrogen cyanide, acetylene, ethane, paraffin hydrocarbons, aromatic organic compounds, and the like.

The three major sand reclamation systems currently available to foundrymen using nobake sands are thermal, wet and dry scrubbing. Thermal reclamation is the most expensive to install and operate, but produces the cleanest reclaimed sand. A thermal reclaimer requires in the order of 1.5 million BTUs of heat per ton of sand treated, or 4.5 million BTUs per ton of metal cast, at a 3:1 sand to metal ratio to remove up to 96 percent of the organic binder residues from any organic nobake sand mold system. The thermal reclamation system is seldom employed in the industry.

A wet reclamation system is less expensive to operate than a thermal reclamation system, but more expensive than a dry scrubbing system. A wet reclamation system will remove from 35–45 percent of the organic binder residue from the used nobake nobake molding sand. However, the sludge byproduct of the wet reclamation operation requires an environmentally safe disposal site.

A dry scrubber system is the least efficient system to reclaim used nobake foundry sand, its efficiency being in the order of removal of from 25–35 percent of the binder residues from the sand processed for a shotblast type dry scrubber. This process is employed most often because of its low installation cost.

In the dry scrubber system of reclamation, the sand is crushed and its surface abraded resulting in up to 20 percent of the sand being processed being lost because of "dust losses". The wet reclamation system has a less severe "dust loss" problem and the thermal system has the least "dust loss" problem.

The binder residues removed by the sand reclamation system have no practical use at this time, and their disposal method is dumping.

In my copending patent application Ser. No. 130,256 filed on Mar. 14, 1980 and issued as U.S. Pat. No. 4,325,424 I teach a mold system and process for nobake casting mold assemblies which overcome many of the deficiencies found in the prior art. A vacuum source means induces ambient foundry air to flow through the mold into a vacuum plenum member. A low BTU gas comprising gas products and condensate matter is evolved from the mold into the plenum member. Combustion air may be mixed with the collected gas products and condensate matter to form a combustible mixture. The combustible mixture may be burned to preheat combustion air as required, produce hot water, and enable one to heat treat castings in the mold assemblies.

An object of this invention is to provide a new and improved system and process for casting metals in nobake sand molds.

Another object of this invention is to provide new and improved apparatus and process for reducing air pollution in foundries employing nobake sand molds.

A further object of this invention is to provide a new and improved apparatus for causing air to flow through selected regions of a nobake mold to thermally decompose the organic binder therein to produce a gas having a low BTU content.

A still further object of this invention is to provide a new and improved system for insitu thermal recovery of sand from a nobake sand mold, producing a gas therefrom that has a low BTU content which is storable or can be used in several ways for preheating air and/or water, for providing heat as required in the foundry.

Another object of this invention is to recover the casting heat from the casting during the cooling cycle.

employed to produce steam (hot water) for operating foundry equipment.

Additionally, a blower 60, via valve means 62 and conduit means 63, may direct the flow of low BTU gas produced through a condenser 64. The condenser 64 enables one to recover the casting heat and seperate tarry oil from gas via valve 66 before directing the gas to storage tank 68. Valve means 70 enables one to draw low BTU gas to fire casting heat treat and/or hot top accessory means as required.

Valve means 72 enables the combustible gas mixture from blower 50 to be directed via conduit means 74 to hot top and/or heat treating accessory means 76 as required for each mold assembly 10.

This system and method of this invention enables the using foundry to substantially reduce air pollution of the ambient of the foundry. Whereas prior casting methods released large amounts of hot gases and particulate matter into the foundry air, the system and method of this invention draws the hot gases and particulate matter into a confined area to be incinerated and disposed of properly without contaminating the foundry about the work stations therein. The castings produced are of excellent quality and are readily shaken out of the "burned" sand. The "burned" sand is readily reclaimed for reuse without introducing pollution problems of sludge and the like which occurred in prior art methods. The nobake sand that has not had the organic binder burned out constitutes only 30 to 50% by volume of the original sand composition content of the mold. This portion of the original volume of sand in the mold is recovered, crushed, screened and combined with the reclaimed sand of this process, cooled and returned for reuse. Pollution problems are greatly reduced by this method.

The following example illustrates the teachings of this Invention:

Two MES scab plate mold assemblies were prepared in matchplate flasks using Pepset(TM) and Wedron 5010 sand. Pepset is the registed trademark od Ashland Chemical Company for a patented phenolic-urethane three part binder system. One part contains a phenolic resin, a second part an isocyanate component, and a third part a liquid catalyst. One mold assembly was employed as control. No attempt was made to seal any of the top surfaces to restrict air penetration or gas evolution.

A 12" by 14" aluminum jacket was inverted and placed on the foundry floor to act as a vacuum plenum for the second mold assembly. A first neoprene rubber seal provided an air tight seal between the floor and the jacket. The second mold assembly was disposed on the other side of the jacket to provide an air tight seal therebetween. An industrial vacuum cleaner purchased from Sears, Roebuck and Company was attached to the vacuum plenum to provide the vacuum means.

The industrial vacuum cleaner was turned on and a considerable current of air could be felt entering into the mold through the top surface indicating a good air tight seal obtained through the employment of the neoprene seal. Gray iron was poured into the two molds. The pouring temperature was 2700 F. The molds were then observed for a period of 45 minutes following the pour. No attempt was made to collect condensate matter.

The vacuum assembly reduced the smoke levels considerably. No smoke was evolved from the vacuumed mold until traces were observed 20 minutes following the pour, while the smoke from the control mold was light to moderate.

Visual examination of the castings revealed that there was no increase in penetration of the vacuumed casting when compared with the control casting. The surfaces of the castings were of acceptable commercial quality. The vacuumed mold was more thermally reclaimed, about 70 percent more binder had been burned out than the control mold.

Condensate matter was observed collected in the cannister of the vacuum cleaner.

Further evaluation of the system and method of this invention indicates the vacuum type system works more efficiently with casting processes wherein high thermal energy is present in the mold such as iron, steel and copper alloy castings and the like. Less efficiency in burnout and shakeout is achieved in low thermal energy molds such as obtained in aluminum castings. In all instances foundry air contamination is substantially reduced. The low BTU gases evolved in the vacuum casting process of this invention range from 90 BTUs per 1000 cubic feet to 180 BTUs per 1000 cubic feet depending upon the type and percentage of organic binder plus binder residues, the casting temperature and the airflow through the mold. The low BTU gases have proven to be an excellent source of fuel for waste heat boilers, heating hot tops, heat treating the castings in the mold assembly and the like.

Care must be exercised in preventing accumulated gases mixed with air in the system from blowing back through the system when ignited. For damage may occur. A line may rupture. Occurrences such as these may result in casting interruption and/or poor quality castings being produced. As shown with the reference to FIG. 3 a blow back may be prevented by inserting a flame arrestor 78 or fire check in the conduit means between the blower 50 and the waste heat boiler 52. Preferably the flame arrestor 78 should be inserted in the conduit means between the boiler (water heater) 52 and the intersection of the conduit means 76 to the conduit means to blower 50. The arrestor 78 may be provided at the burner tip of the boiler 52. Suitable flame arrestors are commercially available, or may easily be constructed as required. In a similar manner a fire check, or check valve, also commercially available, may be used in lieu of, or in conjunction with the arrestor 78. It was also found that burning near or under the mold eliminates blowbacks and explosions.

It has also been discovered that the gas recovered from the mold 10 may be burned either in the plenum chamber of the support member 16 or in the connecting means therefrom. Walls 18, 20, 22, and 24 may be designed in a manner whereby the plenum chamber has an increasing cross-section as it extends further from the connecting means affixed to the support member 16. This arrangement is further described with reference to FIG. 4.

With reference to FIG. 4, connecting means 110 provides a conduit from the plenum chamber of mold 10 to heat exchanger 112. The connecting means preferably has a heat resisting liner to permit full combustion of the gas extracted from the mold 10. A variable control means 114 is provided in the conduit means 110 to control the aspiration of combustion air into the gas stream prior to combustion. Valve 122 enables one to introduce additional air as required to aid combustion. Heat is extracted from the combusted gas in the heat exchanger 112. A fan 116 induces a draft in exhaust stack 118 to exhaust the combusted gas to the atmosphere and to induce the flow of mold gas from the mold 10, the aspiration of air into the mold gas via valve 114 and valve 122, as required, the mixing of the same in connecting means 110. Additionally the fan 116 induces the exhaust gas to flow from heat exchanger 112 via connecting means 124 through the fan 116 to the exhaust stack 118 via connecting means 126.

Sensing means 120 monitors the temperature of the exhaust gas in connecting means 124 at location 128 to prevent damage to fan 116 by high temperature gases. Valve 130 in response to a signal from sensing means 120 allows cooling air to be introduced into the exhaust gas to control the temperature thereof. Sensing means 120 also monitors the carbon dioxide content of the exhaust gas at location 132 and in response thereto a high efficiency combustion level for the system. When required, additional air may be introduced manually by valve 122 to also control combustion of the low BTU gas. Valve 114 is controlled by means 120 to maintain a desired range of undermold pressure.

The sensing means 120 is preferably accompanied by a microprocessor to monitor the appropriate signal received, to interpret the signal, compare the interpreted data with stored standard data, and responds accordingly by activating the proper controlling components of the system as required.

As illustrated in FIG. 4, benefits which are to be achieved by this modification of the VACLAIM system are, a clean atmosphere in the foundry, recovery of some of the casting and binder waste heat, binder burnout sand reclamation improvements, cost savings, and incineration of mold gases to established environmental standards.

It has also been discovered that an induced flow of air through the mold may be accomplished by the use of pressurized air. Referring to FIG. 5 there is shown mold 150 which is a modification of mold 10. The mold 150 comprizes cope 12, drag 14 and preferably a solid bottom 152. Organic resin bonded sand is shaped about a pattern to form a cavity into which metal is cast.

An air inlet pipe 154 is inserted into the mold. Preferably the pipe 154 is perforated to provide a plurality of apertures through which air can be introduced into the bonded sand. The air is sufficiently pressurized to cause the air to flow through the sand without fracturing the bonded structure. The airflow is preferably initiated just prior to casting of the metal and continued until after the casting is complete. The air introduced into the sand is heated by the cast metal in the regime of the sand about the metal casting thereby forming an initial hot sand zone. The heating of the sand, combustion of the organic binder, and production of the low BTU gas is the same as described heretofore for the operation of the system for mold 10. The solid bottom 152 prevents the gas from exiting mold 150 in a manner like mold 10 and is therefore evolved through the top surface 156. Ignition of the low BTU gas over the surface 156 provides a hot top for the mold 150. A hood 158 is provided over the top of the mold 150 to recover the exhaust from the burning low BTU gas and to exhaust the gas outside of the foundry or to recover a portion of the thermal energy in a heat exchanger via pipe 160.

Most foundries have a source of pressurized air for the operation of various tools and machines. Use of a restriction valve enables one to reduce the pressure of this air sufficiently for use in the mold 150.

A second perforated member 162 is employed to collect the low BTU gas when the surface 156 is covered to prevent evolving of the gas through the top. In such an instance, the system shown and described in FIG. 4 is modified by substituting mold 150 for mold 10. Variable control valve 114 is placed in the inlet air line to mold 150. The remainder of the components of the system operate in the same manner as described heretofore.

Alternatively, mold 10 may also be utilized by introducing controlled pressurized air through the plenum chamber and into the mold bottom. Combustion of the organics proceed from the bottom up. Burning of the sand is as good as the previous embodyments.

I claim as my invention:

1. An improved mold system including at least one nobake casting mold comprising a cope, a drag and a nobake foundry sand composition including an organic binding material, the improvement comprising first means connected to the mold for inducing a flow of air through the sand composition of the mold to aid combustion of the organic binding material to produce a low BTU content gas, a second means connected to the mold for collecting at least the low BTU content gas, means for mixing combustion air with the low BTU content gas to form a combustible mixture, and means for burning the combustible mixture to generate thermal energy.

2. The improved mold systems of claim 1 wherein said first means further including a source of pressurized air and an air inlet pipe, the air inlet pipe is inserted into the mold and the source of pressurized air is connected to the inlet pipe.

3. The improved mold system of claim 2 wherein the source of pressurized air utilized to operate tools and equipment of a foundry.

4. The improved mold system of claim 2 and including means for mixing combustion air with the low BTU content gas to form a combustible mixture, and means for burning the combustible mixture to generate thermal energy.

5. The improved mold system of claim 4 including at least one means selected from the group consisting of hot top and heat treat accessory oriented with respect to the mold assembly and said at least one means including said means for burning the combustible mixture, and conduit means connecting the at least one means to the mixing means.

6. The improved mold system of claim 2 and including a hood disposed over the top surface of the mold and spaced therefrom an exhaust stack affixed to the hood to direct collected gas away from the hood.

7. The improved mold system of claim 2 and further including a perforated member inserted into the mold for collecting the low BTU gas produced in the mold.

8. A method for casting molten metal in a nobake sand mold assembly comprising (a) affixing a source of pressurized air to the mold assembly;

(b) causing air to flow through bonded sand of the nobake mold assembly;

(c) providing means to collect the air and any gaseous products caused to flow through the mold assembly;

(d) casting molten metal into a mold assembly while maintaining the airflow;

(e) heating portions of the sand mold assembly to a temperature sufficient to decompose organic binder materials bonding the mold sand together to produce a low BTU content gas and burned out regions of sand;

(f) cooling the casting in the mold assembly for a period of time while maintaining the airflow, and (g) recovering the burned sand from the mold assembly for reuse in making foundry molding sand composition for casting molten metal.

9. The method of claim 8 and including the additional process steps of mixing combustion air with the low BTU content gas to form a combustible mixture, and burning the combustible mixture to produce thermal energy.

10. The method of claim 9 and including the additional process step of utilizing the thermal energy to heat the hot top of a mold assembly.

11. The method of claim 10 and including the additional step of utilizing the thermal energy to heat treat the casting in the mold assembly.

12. The method of claim 9 and including the additional process step of utilizing the thermal energy in a waste heat boiler.

* * * * *